US005275418A

United States Patent [19]

Yiu

[11] Patent Number: 5,275,418

[45] Date of Patent: Jan. 4, 1994

[54] TARGET

[76] Inventor: Chih-Hao Yiu, 7F-1, No. 30, Lin Shen Road, Taichung, Taiwan

[21] Appl. No.: 15,841

[22] Filed: Feb. 23, 1993

[51] Int. Cl.[5] ..... F41J 5/04; F41J 3/00

[52] U.S. Cl. ..... 273/376; 273/403

[58] Field of Search ..... 273/408, 407, 376, 374, 273/403

[56] References Cited

U.S. PATENT DOCUMENTS 2,501,218 3/1950 Hill ..... 273/403

FOREIGN PATENT DOCUMENTS 610906 10/1948 United Kingdom ..... 273/408

1167384 10/1969 United Kingdom ..... 273/408

*Primary Examiner*—Benjamin H. Layno

*Attorney, Agent, or Firm*—Lalos & Keegan

[57] ABSTRACT

A target includes a rim, a ring engaged in the rim, a number of depressions formed in the rear portion of the ring, a frame having a number of spaces and a number of fins formed in the outer peripheral portion, a protrusion formed on each of the fins for engagement with the depressions of the ring. The protrusions of the fins are disengaged from the depressions and engaged with the other depressions when the frame is rotated relative to the ring.

8 Claims, 9 Drawing Sheets

TARGET

BACKGROUND OF THE INVENTION

1. Field of the Invention

The present invention relates to a target, and more particularly to a target having an adjustable target plate.

2. Description of the Prior Art

Typical targets include a disc-shaped body divided into a plurality of sectors which are further divided into a plurality of areas by two or more concentric circles, each of the sectors is marked with a basic numeral or a basic score, and the areas located within one of the sectors represents a score which equals to one, two or three times of the basic numeral, such that each area represents a different score. In shooting games or in shooting practices, in order to gain a predetermined score quickly, the participants will aim at the areas of higher score, such that the areas representing higher scores will be shot at more frequently and will be easily worn out in a short period of time such that the whole target has to be thrown away. However, it is to be noted that part of the target, particularly the areas representing lower scores, is still in good order and can still be used.

The present invention has arisen to mitigate and/or obviate the afore-described disadvantages of the conventional targets.

SUMMARY OF THE INVENTION

The primary objective of the present invention is to provide a target in which the marked area can be changed or adjusted such that the worn out areas can be rotated or moved to another place.

In accordance with one aspect of the present invention, there is provided a target comprising a rim including a front portion and a rear portion having a plurality of projections extended rearward therefrom, a ring engaged in the rim and including a plurality of lugs extended radially outward therefrom for engagement with the projections of the rim so that the ring is coupled to the rim, the ring including a rear portion having a plurality of depressions formed therein, a frame including a plurality of spaces formed therein and a plurality of fins formed in an outer peripheral portion thereof, a protrusion formed on each of the fins for engagement with the depressions of the ring, and a base fixed to the cover for retaining the ring and the frame in place, the protrusions of the fins being disengaged from the depressions when the frame is rotated relative to the ring and engaged with the other depressions when the frame is further rotated relative to the ring.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
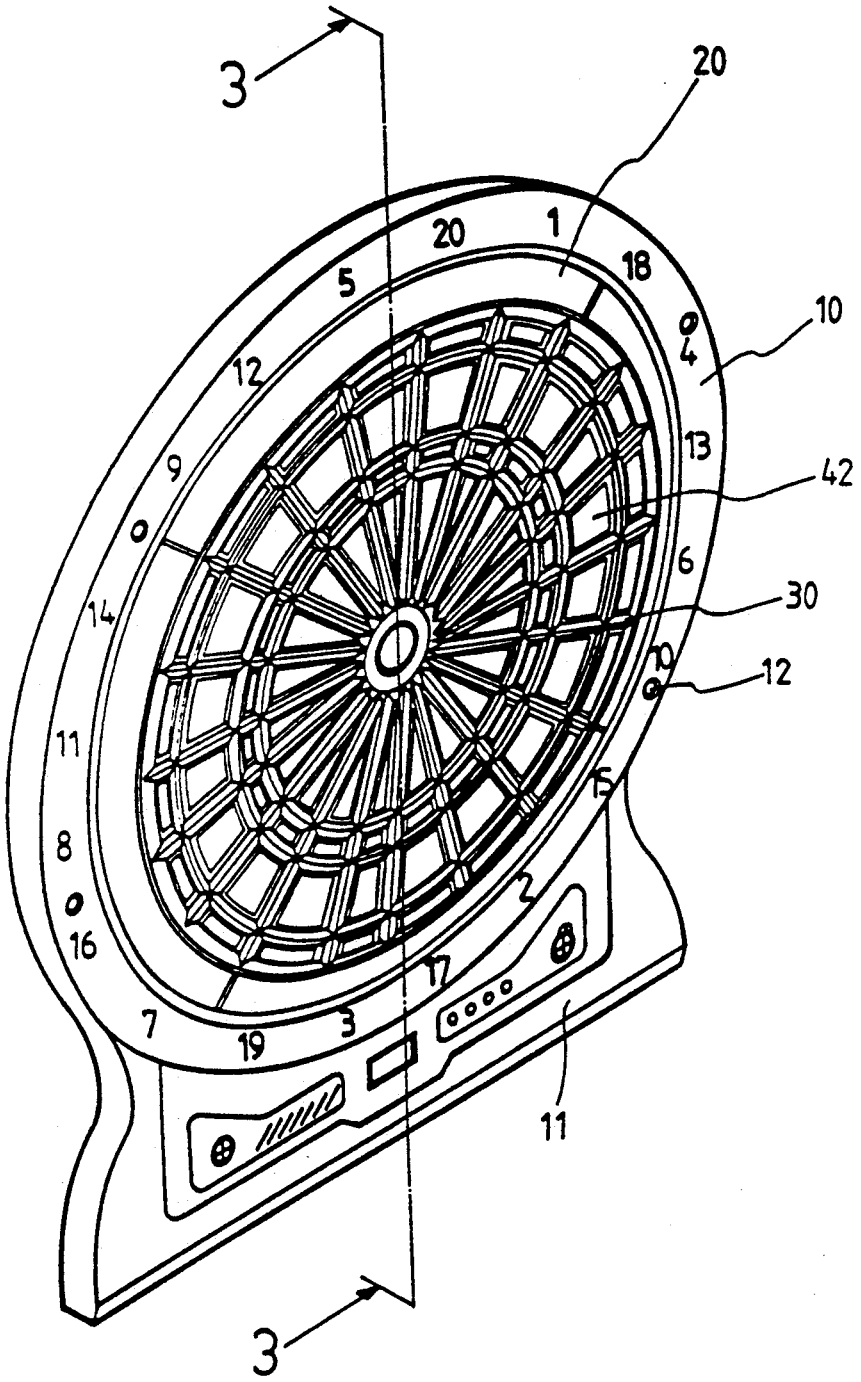
FIG. 1 is a perspective view of a target in accordance with the present invention.
Figure 2:
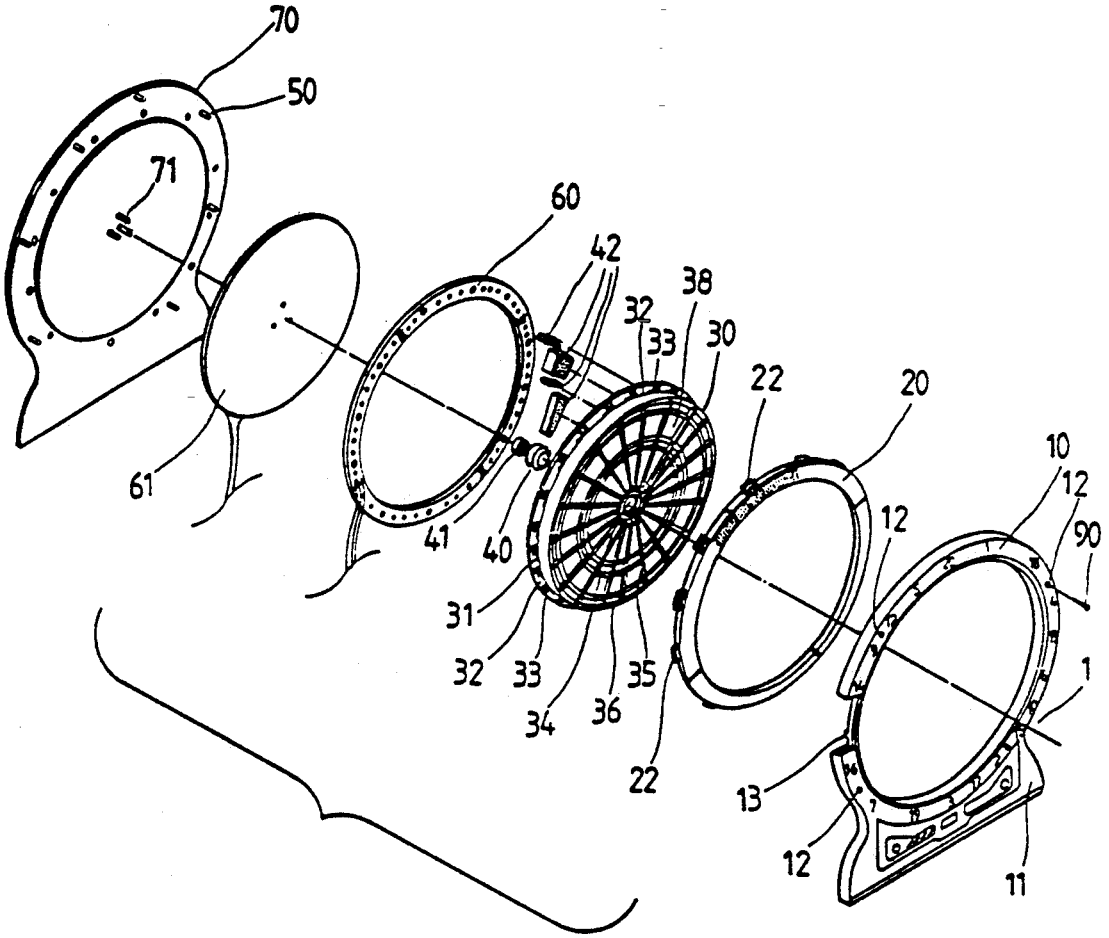
FIG. 2 is an exploded view of the target.
Figure 3:
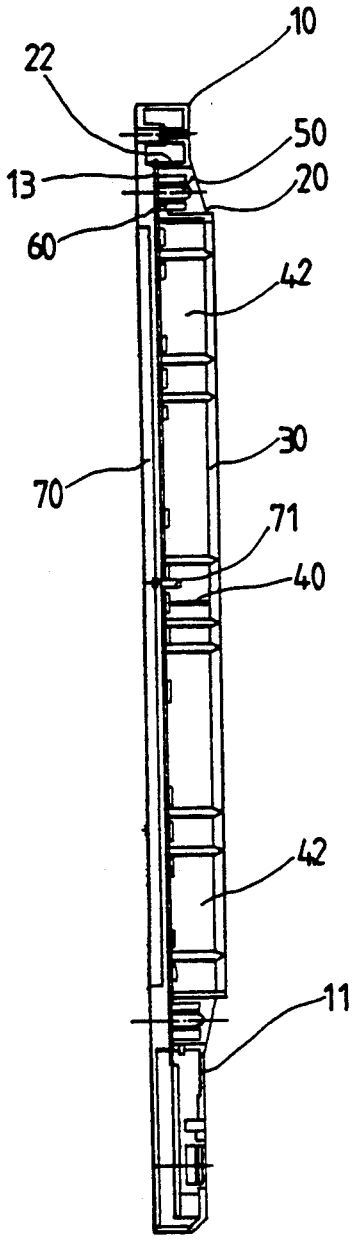
FIG. 3 is a cross sectional view of the target, taken along lines 3—3 of FIG. 1.
Figure 4:
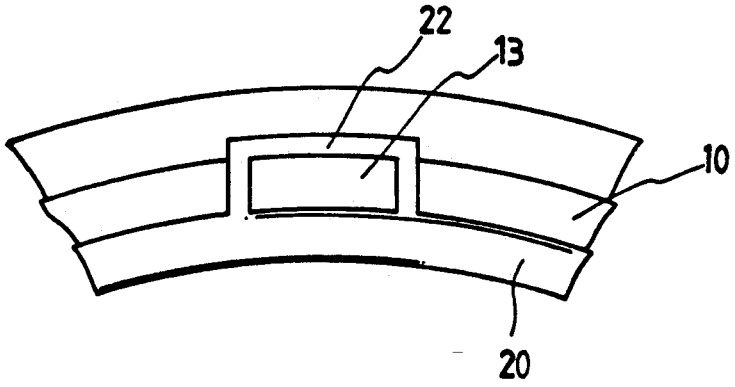
FIG. 4 is a schematic view illustrating the engagement between the frame and the ring.

Referring to the drawings and initially to FIGS. 1, 2 and 3, a target in accordance with the present invention comprises generally a cover 1 including a rim 10 and a panel 11 formed integral in the lower portion thereof, the rim 10 including a plurality of numerals provided around the front portion thereof, a plurality of screw holes 12 formed therein for engagement with screws 90 respectively, and a plurality of projections 13 extended rearward therefrom; a ring 20 including an outer diameter slightly smaller than the inner diameter of the rim 10 such that the ring 20 can be engaged in the rim 10 and including a plurality of lugs or loops 22 extended radially outwards therefrom for engaging with the projections 13 of the rim 10 (FIG. 4) by such as force-fitted engagement such that the ring 20 can be coupled to the rim 10 of the cover 1. The ring 20 is preferably made of transparent materials.

A frame 30 includes a plurality of fins 32 disposed around the outer peripheral portion thereof, each of the fins 32 includes a slit 31 formed in a first end thereof and formed between the fin 32 and the frame 30 such that the first end of each of the fins 32 is flexible and resilient, a protrusion 33 formed on the first end of each of the fins 32 for engagement with the respective depressions 21 (FIG. 7) which are formed in the rear portion of the ring 20, such that the frame 30 can be coupled to the ring 20. It is to be noted that, when the frame 30 rotates relative to the ring 20, the protrusions 33 can be disengaged from the depressions 21 of the ring 20 due to the resilient and flexible characteristics of the fins 32, and can further be engaged with the other depressions 21 when the frame 30 is further rotated relative to the ring 20. The frame 30 includes a hub 34 formed in the center thereof for receiving a stub 40 or a block, a center 41 is engaged in the stub 40 (FIG. 6), and a plurality of straight bars 35 extended radially outwards from the hub 34 and three concentric circles 36 formed therein, the bars 35 and the concentric circles 36 have a thickness such that a plurality of spaces 38 are formed within the frame 30, and a block 42 is engaged in each of the spaces 38.

Figure 5:
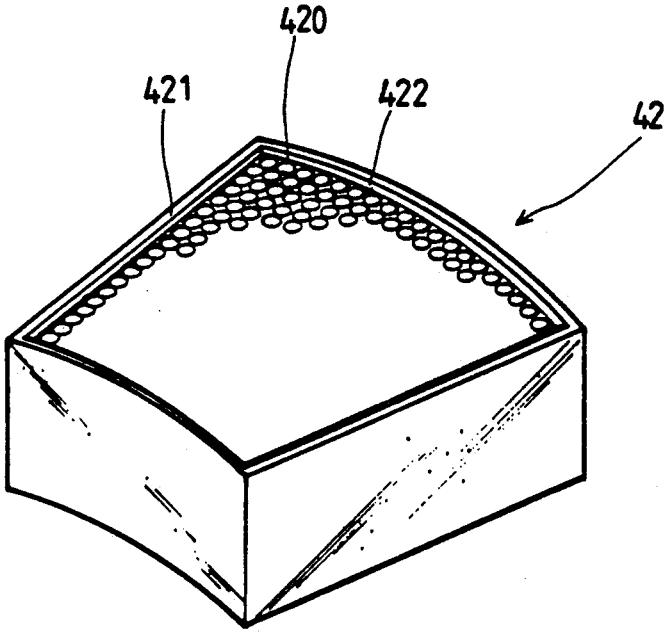
FIG. 5 is an enlarged perspective view of the block.
Figure 6:
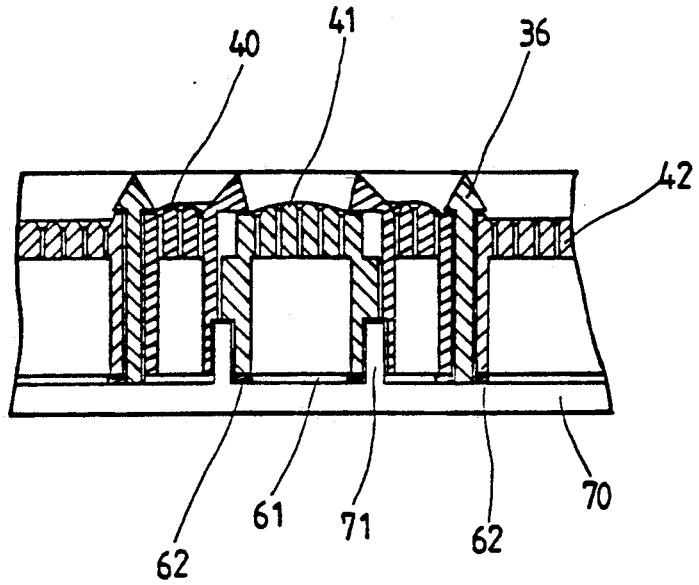
FIG. 6 is an enlarged partial cross sectional view illustrating the center portion of the target.
Figure 7:
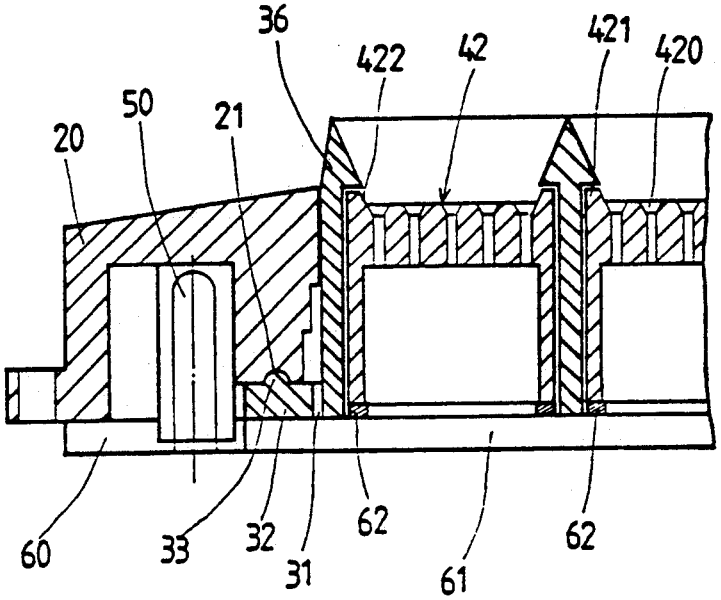
FIG. 7 is an enlarged partial cross sectional view similar to FIG. 6, illustrating the peripheral portion of the target.

The stub 40, the center 41 and the blocks 42 are preferably made of soft materials, such as cork or foamable materials. As best shown in FIGS. 5 to 7, each of the blocks 42 includes a wall member 421 extended upward from the peripheral portion thereof, a tapered surface 422 formed in the inner portion of the wall member 421, and a plurality of holes 420 formed in each of the blocks 42. Similarly, a plurality of holes are formed in the stub 40 and the center 41 such that the arrows hitting the target can be easily attached to the target.

A plate 61 and a ring 60 are attached to the rear portion of the frame 30, a plurality of switches or sensors 62 disposed in the plate 61 (FIGS. 6 and 7) and contacted with the blocks 42 and the stub 40 and the center 41, and a base 70 is fixed to the cover 1 by screws 90 and includes three pins 71 extended from the center thereof, the stub 40 is engaged with the pins 71 and engageable with the sensor 62 of the plate 61. A plurality of light bulbs 50 are engaged in the peripheral portion of the base 70 and plugged in the ring 60 and arranged within the ring 20. When the blocks 42 and the center 41 and the stub 40 are shot at, the sensors 62 are actuated such that the electronic parts (not shown) disposed within the panel 11 may generate sounds and the like, and/or the light bulbs 50 are energized. The electronic parts are not related to the invention and will not be described in further detail.

Figure 8:
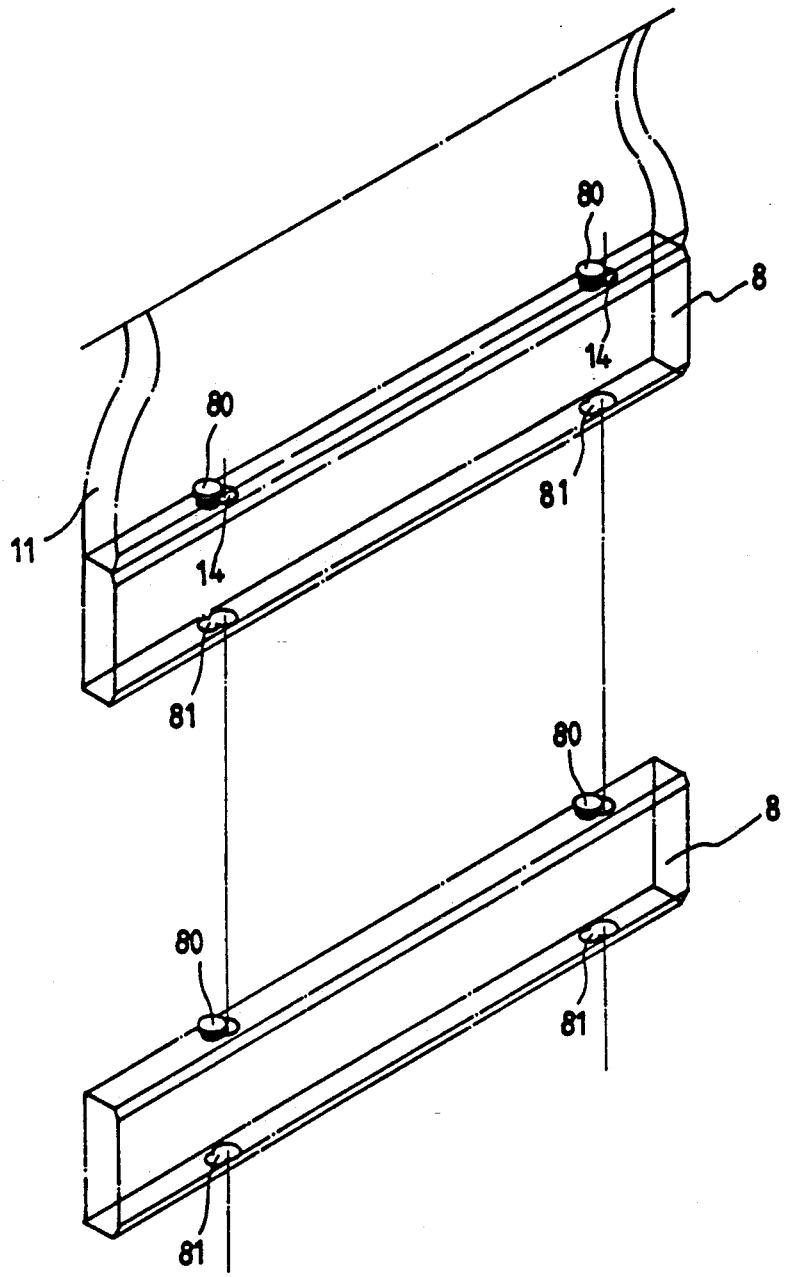
FIG. 8 is a schematic view illustrating the attachment of a casing to the target.
Figure 9:
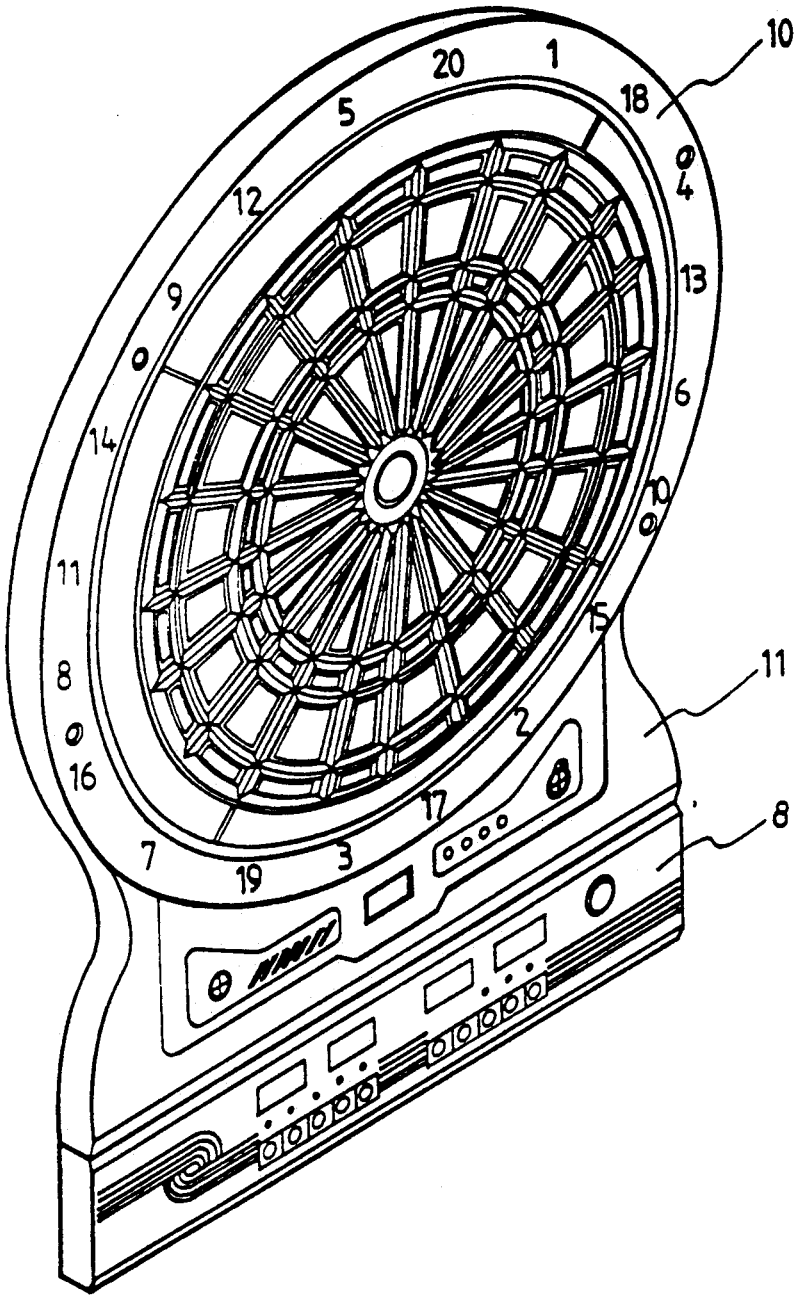
FIG. 9 is a perspective view of the target with a casing attached thereto.

Referring next to FIGS. 8 and 9, the panel 11 may include key holes 14 formed in the bottom portion thereof for engagement with the engaging means 80 of a casing 8 which may further include key holes 81 formed in the bottom portion thereof for engagement with another casing. The casing 8 may include another type of chip or central processing unit which is different from that disposed in the panel 11 so as to provide another type of sound and the like when the center 41, the stub 40 or the blocks 42 are shot at. The electronic parts are also not related to the invention and will not be described in further detail.

When part of the blocks 42 are damaged, particularly the blocks located in some area where normally focused by the users, the frame 30 can be rotated relative to the ring 20 due to the resilient and flexible characteristics of the fins 32, such that the blocks 42 in good order can be rotated to the positions where the damaged blocks previously located, and such that the whole target need not be discarded when part of the blocks 42 are damaged.

Alternatively, the blocks 42, the center 41 and the stub 40 can be easily removed when the base 70 and the plate 61 are disengaged from the cover 1 and the frame 30 such that the blocks 42, the center 41 and the stub 40 can be easily replaced.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A target comprising a rim including a front portion and a rear portion having a plurality of projections extended rearward therefrom, a ring engaged in said rim and including a plurality of lugs extended radially outward therefrom for engagement with said projections of said rim so as to couple said ring to said rim, said ring including a rear portion having a plurality of depressions formed therein, a frame including a plurality of spaces formed therein and a plurality of fins formed in an outer peripheral portion thereof, a protrusion formed on each of said fins for engagement with said depressions of said ring, and a base for retaining said ring and said frame in place, said protrusions of said fins being disengaged from said depressions and engaged with the other depressions when said frame is rotated relative to said ring.

2. A target according to claim 1, wherein each of said fins includes a first end having a slit formed therein and formed between said first end and said frame such that said first end is flexible, and said protrusions are formed on said first ends of said fins.

3. A target according to claim 1 further comprising a plate attached to said frame and including a plurality of sensors disposed therein, a block received in each of said spaces of said frame and contacted with said sensors.

4. A target according to claim 3 further comprising a plurality of light bulbs plugged on said plate and arranged within said ring, said ring is made of transparent materials.

5. A target comprising a cover including rim and a panel formed in a lower portion of said rim, said rim including a front portion and a rear portion having a plurality of projections extended rearward therefrom, a ring engaged in said rim and including a plurality of lugs extended radially outward therefrom for engagement with said projections of said rim so that said ring is coupled to said rim, said ring including a rear portion having a plurality of depressions formed therein, a frame including a plurality of spaces formed therein and a plurality of fins formed in an outer peripheral portion thereof, a protrusion formed on each of said fins for engagement with said depressions of said ring, a block engaged in each of said spaces of said frame, and a base fixed to said cover for retaining said ring and said frame in place, said protrusions of said fins being disengaged from said depressions and engaged with the other depressions when said frame is rotated relative to said ring.

6. A target according to claim 5, wherein each of said fins includes a first end having a slit formed therein and formed between said first end and said frame such that said first end is flexible, and said protrusions are formed on said first ends of said fins.

7. A target according to claim 5 further comprising a plate attached to said frame and including a plurality of sensors disposed thereon for engagement with said blocks.

8. A target according to claim 7 further comprising a plurality of light bulbs plugged on said plate and arranged within said ring, said ring is made of transparent materials.

* * * * *